US008651982B1

(12) United States Patent
Carnahan

(10) Patent No.: US 8,651,982 B1
(45) Date of Patent: Feb. 18, 2014

(54) BASEBALL BATTING SKILL IMPROVEMENT SYSTEMS

(75) Inventor: Scott Carnahan, McMinnville, OR (US)

(73) Assignee: Scott W. Carnahan, McMinnville, OR (US)

( * ) Notice: Subject to any disclaimer, the term of this patent is extended or adjusted under 35 U.S.C. 154(b) by 94 days.

(21) Appl. No.: 13/430,569

(22) Filed: Mar. 26, 2012

Related U.S. Application Data

(60) Provisional application No. 61/475,007, filed on Apr. 13, 2011.

(51) Int. Cl.
*A63B 69/00* (2006.01)

(52) U.S. Cl.
USPC ..... 473/457; 473/422

(58) Field of Classification Search
USPC ..... 473/422, 437, 457, 450, 458, 464, 615
See application file for complete search history.

(56) References Cited

U.S. PATENT DOCUMENTS

| | | | | |
|---|---|---|---|---|
| 1,017,376 | A | 2/1912 | Brandt et al. | |
| D187,033 | S | 1/1960 | Dunn et al. | |
| 3,048,399 | A * | 8/1962 | Breitbach | 473/457 |
| 3,206,195 | A * | 9/1965 | Myers | 473/457 |
| 3,268,226 | A * | 8/1966 | Martino | 473/457 |
| 3,809,397 | A * | 5/1974 | Gruenewald | 473/457 |
| 4,416,451 | A * | 11/1983 | Solloway | 482/111 |
| 5,269,511 | A * | 12/1993 | Chavez | 473/457 |
| 5,388,822 | A * | 2/1995 | Cassady | 473/451 |
| 5,395,107 | A * | 3/1995 | De Pippo | 473/451 |
| 5,888,154 | A | 3/1999 | Hartman | |
| 7,935,009 | B2 * | 5/2011 | Mullin | 473/457 |
| 7,985,147 | B1 * | 7/2011 | Allen | 473/457 |
| 8,066,590 | B2 * | 11/2011 | Doherty | 473/457 |
| 8,277,341 | B1 * | 10/2012 | Vignola | 473/457 |
| 2008/0039241 | A1 * | 2/2008 | Pope | 473/457 |
| 2008/0261729 | A1 * | 10/2008 | Mullin | 473/457 |
| 2011/0070980 | A1 * | 3/2011 | Doherty | 473/457 |

* cited by examiner

*Primary Examiner* — Mitra Aryanpour
(74) *Attorney, Agent, or Firm* — RG Patent Consulting, LLC; Rachel Gilboy

(57) ABSTRACT

A baseball batting skill improvement system for providing a user-batter with instant feedback on the correctness of muscle alignment and form during a batter swing motion in response to a pitched baseball. Baseball batting skill improvement system comprises a ball catcher bat with a ball catcher assembly. The ball catcher assembly comprises a round mounting plate with an elongated U-hoop rigidly attached and having a flexible cord-net attached to net rings spaced on and about the U-hoop. The flexible cord net is a catch bag that will allow a pitched baseball to enter if the form of the user-batter is correct.

19 Claims, 5 Drawing Sheets

BASEBALL BATTING SKILL IMPROVEMENT SYSTEMS

CROSS-REFERENCE TO RELATED APPLICATION

The present applications are related to and claims priority from prior provisional application Ser. No. 61/475,007, filed Apr. 13, 2011 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of sports practice devices and more specifically relates to baseball batting skill improvement systems.

2. DESCRIPTION OF THE RELATED ART

Playing a sport is a useful way for people to increase their mastery of nature and the environment, to spend leisure time and to promote fitness of their person. Baseball is one such sport; baseball modernly played for pleasure and/or professionally for money. In baseball players must develop their skills in batting because without a hit, a team will probably not score enough to win a game. Pitchers develop fast balls and curve balls and attempt to pitch them into the strike zone past the batter. Timing, power, and aim are difficult skills to develop for the batter and are only developed through repetition and technique. It is desirable to hone these techniques.

Many student athletes can connect with a pitched ball, but will not typically excel at the skill because of poor form. Unfortunately, the type of real life practice that an athlete needs to develop these skills is, to a great extent, limited to a short time window and to a particular location. This can be a hindrance on developing such skills. Inclement weather can hinder practice as well as lack of a sufficiently sized place to practice. Batting cages have been designed to provide high repetition but the batter must often travel to a particular location and schedule a particular time to use them, making the task expensive and inconvenient. Hitting balls with a bat also provides that much of the time spent, if alone, is chasing the balls to retrieve them to be hit again. The problems of inefficiency, inconvenient locations and inopportune timing still exist. Also, there is a lack of feedback on proper technique and muscle alignment. What is desired is a system that will provide the batter with instant feedback on his form and the ability to practice whenever it is convenient, at minimal cost, in-doors or out.

Various attempts have been made to solve the above-mentioned problems such as those found in U.S. Pat. Nos. 3,268,226; 5,269,511; 2008/0039241; D187033; 1,017,376; and 5,888,154. This prior art is representative of sport practice devices. None of the above inventions and patents, taken either singly or in combination, is seen to describe the invention as claimed.

Ideally, a baseball batting swing improvement system should serve to promote efficient and effective batting swing techniques, successfully mimicking a regulation baseball bat, and, yet would operate reliably and be manufactured at a modest expense. Thus, a need exists for a reliable baseball batting skill improvement system to improve batting skills and to avoid the above-mentioned problems.

BRIEF SUMMARY OF THE INVENTION

In view of the foregoing disadvantages inherent in the known practice baseball bat art, the present invention provides a novel baseball batting skill improvement system. The general purpose of the present invention, which will be described subsequently in greater detail, is to provide versatility in practice locations, reduce time chasing base balls, improve batting skills and muscle memory.

A baseball batting skill improvement system is disclosed herein, in a preferred embodiment, comprising a ball catcher bat having a proximate end with a handgrip shaft portion terminated with a knob, a barrel portion, and a distal end attached to a ball catcher assembly. The ball catcher assembly comprises a U-hoop (having an apex end, a double end), net rings, a round mounting plate (having a first side, a second side), and a flexible cord net having attachment loops.

The barrel portion is preferably located between the proximate end and the distal end. The proximate end of the ball catcher bat is smaller in diameter than the distal end and is useable by a user-batter to grip and swing the ball catcher bat. The knob comprises a larger diameter than the handgrip shaft portion and the knob thereby substantially prevents the ball catcher bat from sliding out of hands of the user-batter. The barrel portion progressively increases in diameter starting adjacent the knob (the narrowest portion) on the proximate end going towards the distal end (the widest portion.) The first side of the round mounting plate of the ball catcher assembly is removably attached to the distal end and is removably attached to the barrel portion using at least one lag screw in preferred embodiments.

In an alternate embodiment, the round mounting plate may further comprise a sleeve centered circumferentially about the barrel portion; removably affixed to the first side of the round mounting plate. The round mounting plate is about 2 times the diameter of the barrel portion providing a landing for attachment of the U-hoop. The round mounting plate is attached via lag screw(s) and the sleeve is attached to the barrel portion via another of the lag screw(s). The double end of the U-hoop is centered perpendicularly to the second side of the round mounting plate; the U-hoop terminating in the apex end and located on a longitudinal axis of the ball catcher bat. The U-hoop may be centrally-affixed on the second side of the round mounting plate surface area and welded in place, but may be of molded construction in other embodiments. The U-hoop, together with the round mounting plate comprises a solid steel construction in preferred embodiments to attain proper weighing and thereby successfully mimicking a regulation baseball bat.

The apex of the U-hoop is also rounded in an effort to mimic an end of a regulation baseball bat, such that air is 'cut' in a similar fashion to swinging the regulation baseball bat. The front opening of the U-hoop is a space located between the double-end having a net on the back side, and comprises the sweet spot of the bat. The sweet spot is about 11 inches long and about 1½ ball widths wide in relation to a baseball. The opening of the U-hoop is preferably wider than the diameter of the barrel portion.

The flexible cord net is equidistantly and removably attached via the attachment loops to the net rings, the net rings are equidistantly affixed around a periphery of the U-hoop, keeping the device well balanced. A tie rod is non-removably attached to the second side of the round mounting plate and to each side of the double end of the U-hoop for removably connecting the flexible cord net to. The flexible cord net preferably comprises holes about one inch across such that the baseball cannot pass therethrough, thereby providing that the user-batter does not have to retrieve the baseball after each successful swing motion. The flexible cord net comprises a 'catch bag' and is 'loose-fitting' so that a pitched baseball will not bounce back out of the flexible cord net; the flexible cord net absorbing the momentum of the baseball. The ball catcher bat is usable to catch the baseball within the confines of the flexible cord net teaching the (desired) swing motion that is correct to the user-batter. In this way the user-batter may be trained to have a correct muscle alignment and aim for a proper impact mimicking a regulation baseball bat and a pitched (regulation) base ball. The ball catcher bat is about the regulation baseball bat length and weight and is usable with a regulation size baseball and a regulation size soft ball. Other sized and weighted balls may be used; however the present invention is designed to work most effectively with regulation balls as a regulation weight bat to mimic equipment used in standard games of baseball. The ball catcher bat is also usable with a hollow plastic practice ball such that the ball catcher bat is able to be used indoors.

The swing motion of the ball catcher bat when aligned properly allows the baseball to enter through the U-hoop perpendicularly to the double end into the flexible cord net thereby providing the user-batter with feed-back of correctness of the swing(ing) motion. In this alignment the double end is located 'flat' (on the same plane with each side of the double end not located at an angle to each other when swinging.)

A method of use for a baseball batting skill improvement system is also disclosed herein and may comprise the steps of gripping the ball catcher bat with a proper one palm up and one palm down grip positioning, assuming a batting stance, properly swinging the ball catcher bat to catch a pitched baseball in the flexible cord net, and removing the pitched baseball from the flexible cord net for a future use.

The present invention holds significant improvements and serves as a baseball batting skill improvement system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, baseball batting skill improvement systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a batting trainer device and more particularly to a baseball batting skill improvement system as used to provide instant feedback on proper swings, useful for indoor or outdoor training, and reduces time chasing baseballs.

Figure 1:
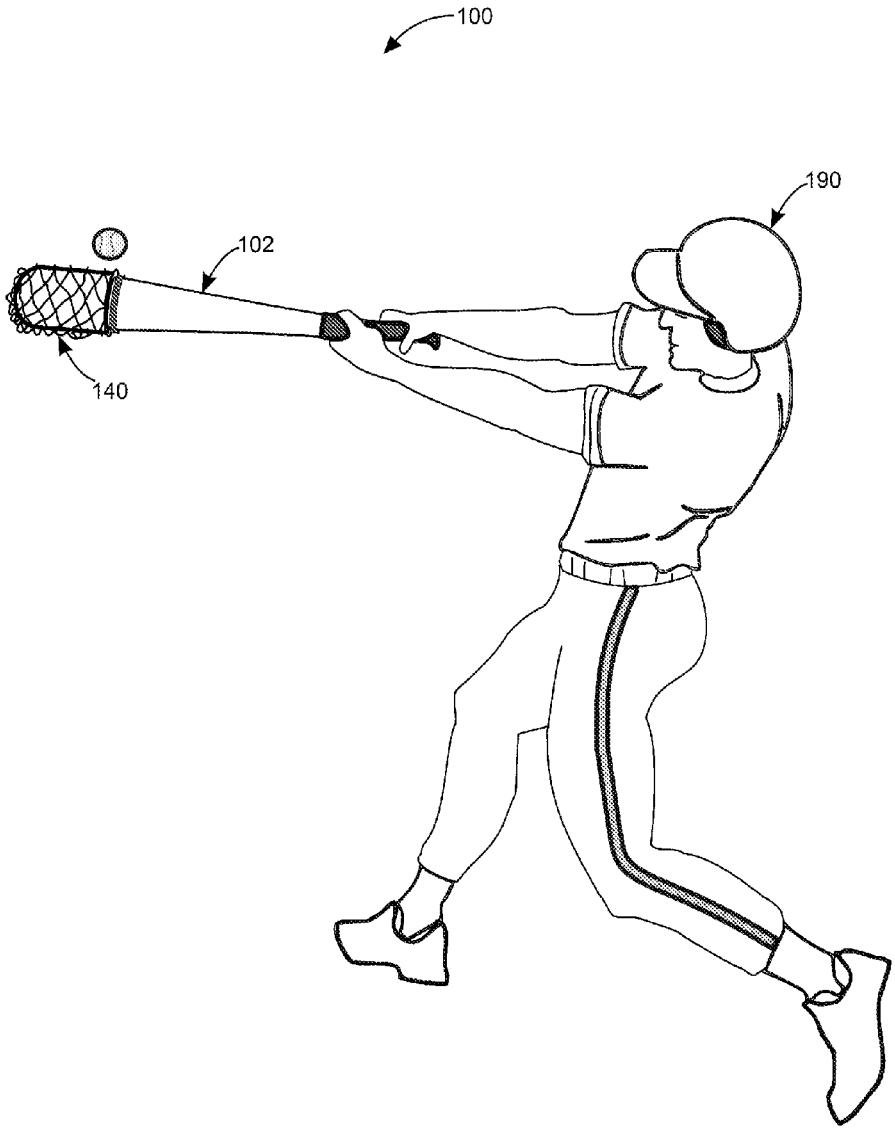
FIG. 1 shows a perspective view illustrating an in-use condition of a baseball batting skill improvement system according to an embodiment of the present invention.

Referring to the drawings by numerals of reference there is shown in FIG. 1, a perspective view illustrating an in-use condition of baseball batting skill improvement system 100 according to an embodiment of the present invention.

Baseball batting skill improvement system 100 comprises ball catcher bat 102 having proximate end 110 (comprising handgrip shaft portion 112 terminated with knob 114), barrel portion 120, and distal end 130 attached to ball catcher assembly 140. Ball catcher assembly 140 has u-hoop 145; u-hoop 145 having apex end 150 and double end 155, net rings 160, round mounting plate 170, and flexible cord net 180 having attachment loops 182. Round mounting plate 170 has first side 172, second side 174, as also shown in FIG. 4.

Barrel portion 120 is (in preferred embodiments) located between proximate end 110 and distal end 130. Proximate end 110 of ball catcher bat 102 is smaller in diameter than distal end 130 of ball catcher bat 102 and is useable by user-batter 190 to grip and swing ball catcher bat 102. Knob 114 comprises a larger diameter than handgrip shaft portion 112; knob 114 prevents ball catcher bat 102 from sliding out of the hands of user-batter 190. Barrel portion 120 progressively increases in diameter starting adjacent knob 114 on proximate end 110 towards distal end 130; however in certain embodiments, finger-grips may be used.

Figure 2:
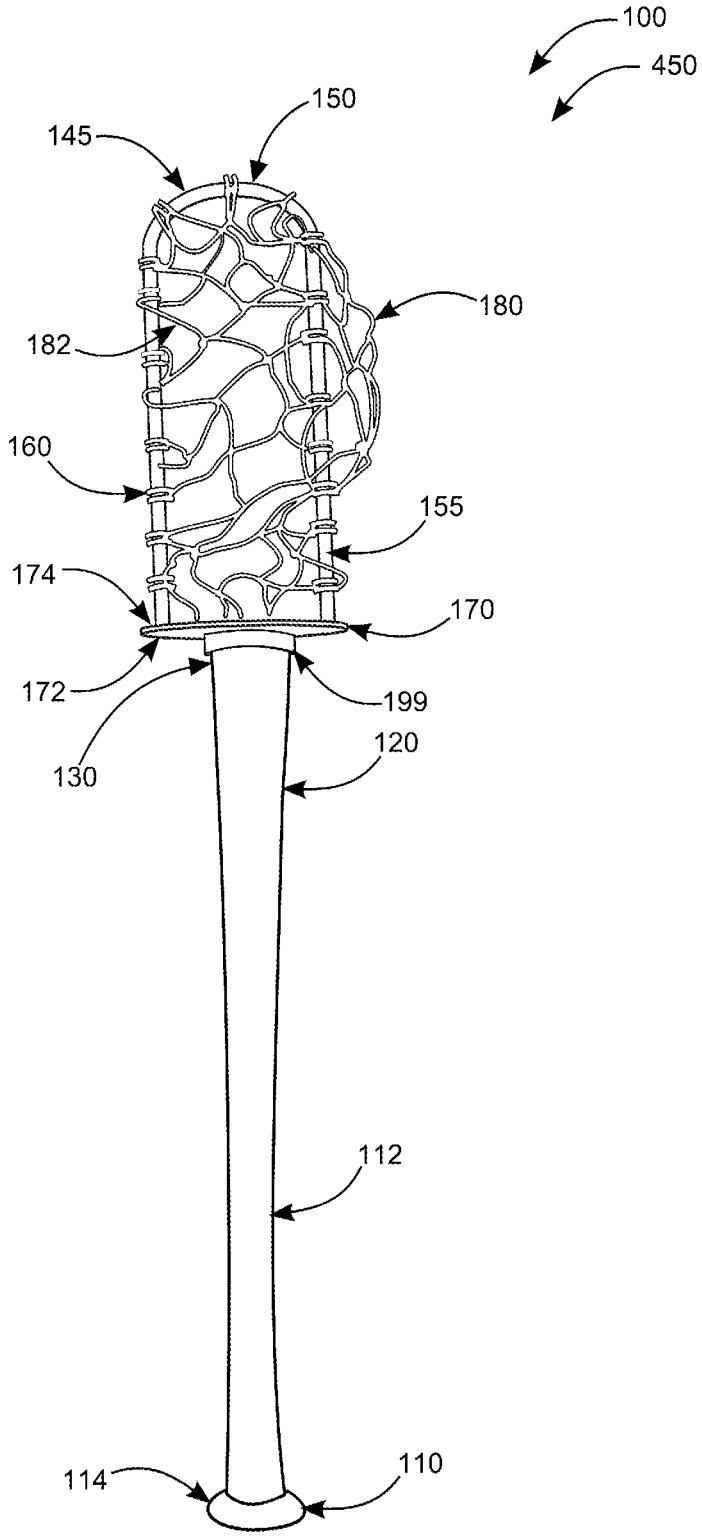
FIG. 2 is a perspective view illustrating a frontal view of a swing ball catcher bat of the baseball batting skill improvement system according to an embodiment of the present invention of FIG. 1.

First side 172 of round mounting plate 170 of ball catcher assembly 140 is removably attached to distal end 130 of ball catcher assembly 140, as shown in FIGS. 2 and 3. Double end 155 of u-hoop 145 is centered perpendicularly to second side 174 of round mounting plate 170, as shown in FIG. 4. U-hoop 145 terminates at apex end 150. U-hoop 145 is located on (along—as an extended portion of handgrip shaft portion 112) the longitudinal axis of ball catcher bat 102 and centrally-affixed on surface area of second side of round mounting plate 170. Flexible cord net 180 is equidistantly and removably attached via attachment loops 182 to net rings 160 and net rings 160 are equidistantly affixed around a periphery of u-hoop 145. Tie rod 186 is non-removably attached to second side 174 of round mounting plate 170 and to each side of double end 155 of U-hoop 145 for removably connecting flexible cord net 180 to. Ball catcher bat 102 is usable to catch a baseball within the confines of flexible cord net 180 teaching a swing(ing) motion that is correct to user-batter 190 thereby baseball batting skill improvement system 100 training user-batter 190 to have correct muscle alignment and aim for a proper impact effectively mimicking a regulation baseball bat and a pitched base ball.

Referring now to FIG. 2, a perspective frontal view illustrating ball catcher bat 102 of baseball batting skill improvement system 100 according to an embodiment of the present invention of FIG. 1.

The opening of u-hoop 145 is preferably wider than the diameter of barrel portion 120 such that a baseball may be caught therein, the ball fitting between u-hoop 145 (when held/swung properly.) Round mounting plate 170 is removably attached (attachable) to barrel portion 120 using at least one lag screw or other suitable fastening means. Round mounting plate 170 may further comprise sleeve 199 centered circumferentially about barrel portion 120 and is removably affixed to first side 172 of round mounting plate 170. Round mounting plate 170 is able to be attached via lag screw(s) and sleeve 199 may be attached to barrel portion 120 via another set of lag screw(s). Optionally ball catcher assembly 140 may comprise a female thread that may be threadingly received onto a male thread located on barrel portion 120 (not shown.) Ball catcher bat 102 is usable with a hollow plastic practice ball such that ball catcher bat 102 is able to be used indoors. Ball catcher bat 102 is about regulation baseball bat length and weight so as to provide user-batter 190 with a frame of reference to promote repeatable muscle memory.

Figure 3A:
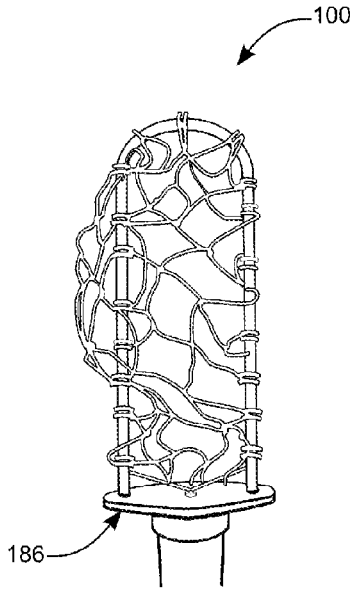
FIG. 3A and FIG. 3B are a rear perspective view and a side perspective view (rear and side, respectively) illustrating the swing ball catcher bat of a baseball batting skill improvement system according to an embodiment of the present invention of FIGS. 1 and 2.
Figure 3B:
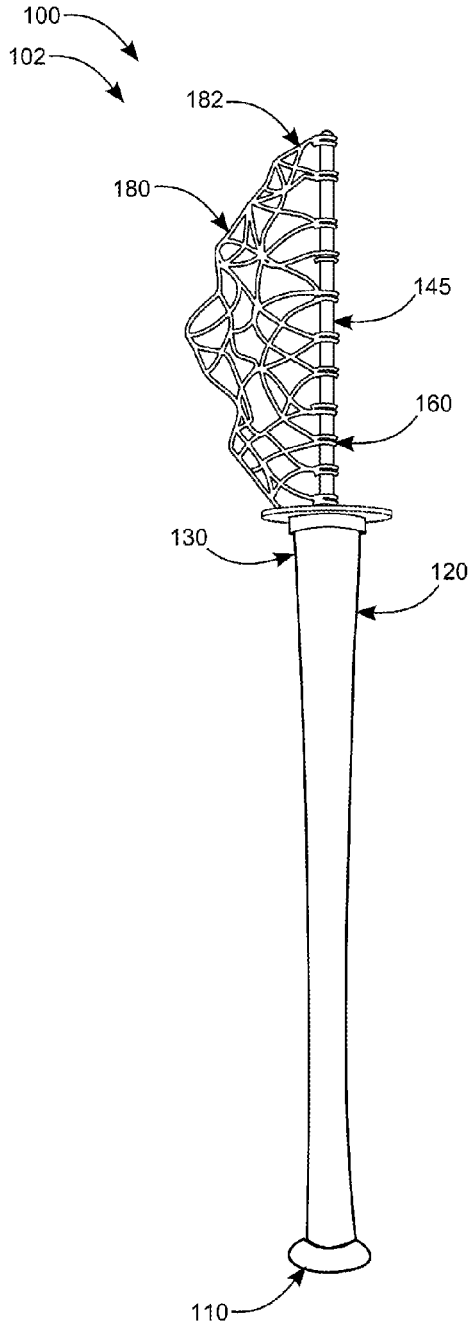

Referring now to FIG. 3A and FIG. 3B, a back perspective view and a side perspective view illustrating the swing ball catcher bat of a baseball batting skill improvement system according to an embodiment of the present invention of FIGS. 1 and 2.

Round mounting plate 170 is about 2 times the diameter of barrel portion 120. Double end 155 of u-hoop 145 may be welded to second side 174 of round mounting plate 170. In other embodiments u-hoop 145 may be molded integral with second side 174. Ball catcher bat 102 is preferably usable with a regulation size baseball and a regulation size soft ball. Flexible cord net 180 comprises holes about one inch across such that a baseball cannot pass therethrough, thereby providing that user-batter 190 does not have to retrieve baseball after each successful swing motion. Flexible cord net 180 comprises a catch bag; flexible cord net 180 is loose-fitting such that a pitched baseball will not bounce back out of flexible cord net 180, flexible cord net 180 absorbing the momentum of a baseball.

Figure 4A:
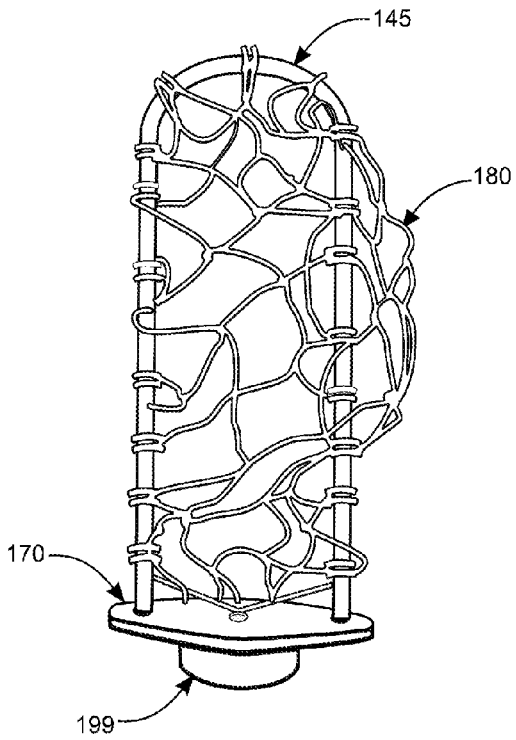
FIG. 4A and FIG. 4B is rear perspective view and a side perspective view (rear and side, respectively) illustrating a ball catcher assembly for use with the swing ball catcher bat of the baseball batting skill improvement system according to an embodiment of the present invention of FIGS. 1-3B.
Figure 4B:
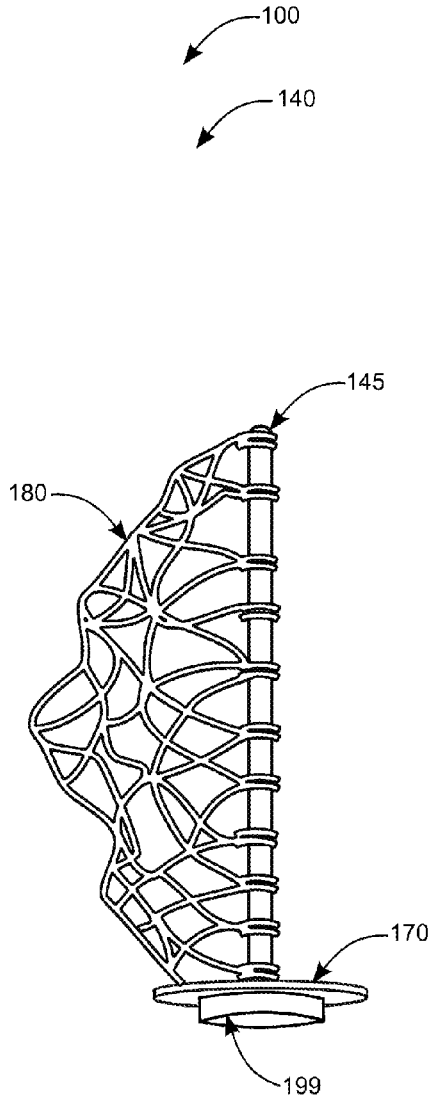

Referring now to FIG. 4A and FIG. 4B is rear perspective view and a side perspective view (rear and side, respectively) illustrating a ball catcher assembly for use with the swing ball catcher bat of the baseball batting skill improvement system according to an embodiment of the present invention of FIGS. 1-3B.

Swing motion of ball catcher bat 102 when aligned properly, allows baseball to enter through u-hoop 145 perpendicularly to double end 155 and into flexible cord net 180 thereby providing user-batter 190 with feed-back of correctness of the swing(ing) motion. An opening of u-hoop 145 is a space located between double end 155 and comprises a sweet spot. Sweet spot is about 11 inches long and about 1½ ball widths wide in relation to a baseball in preferred embodiments. Apex end 150 of u-hoop 145 is rounded to mimic an end of a regulation baseball bat, such that air is cut in a similar fashion to swinging a regulation baseball bat. U-hoop 145, together with round mounting plate 170 comprises a solid steel construction in preferred embodiments; however may comprise other materials such as aluminum, composite, wood, or the like in alternate embodiments.

Baseball batting skill improvement system 100 according to an embodiment of the present invention of FIGS. 1-4, may be sold as kit 450 comprising the following parts: at least one ball catcher bat 102 with u-hoop 145 and flexible cord net 180; at least one at least one baseball; and at least one set of user instructions. Baseball batting skill improvement system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different weight, size and color combinations, parts may be sold separately, etc., may be sufficient.

Figure 5:
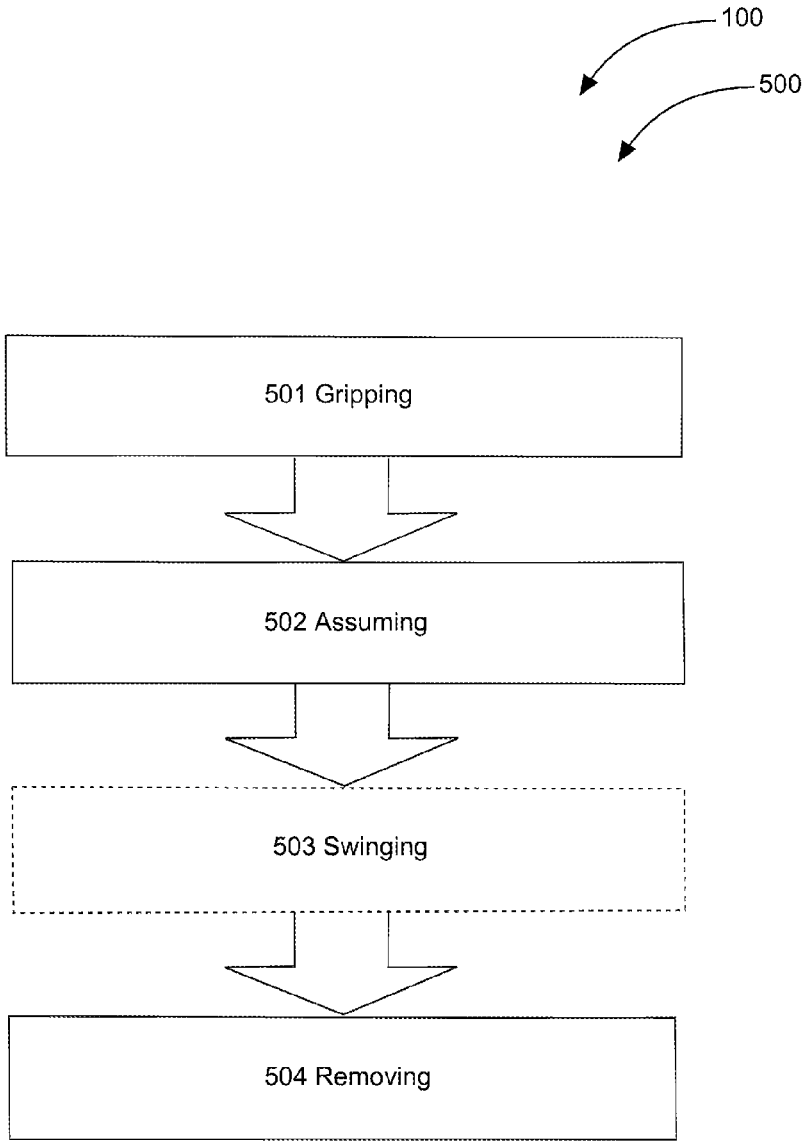
FIG. 5 is a flowchart illustrating a method of use of a baseball batting skill improvement system according to an embodiment of the present invention of FIGS. 1-4B.

Referring now to FIG. 5, showing a flowchart illustrating method of use 500 for baseball batting skill improvement system 100 according to an embodiment of the present invention of FIGS. 1-4B.

Method of use 500 for baseball batting skill improvement system 100 may comprise the steps of: step one 501 gripping ball catcher bat 102 with a proper one palm up and one palm down grip; step two 502 assuming a batting stance; step three 503 swinging ball catcher bat 102 to catch a pitched baseball in a flexible cord net 180; and step four 504 removing a pitched baseball from flexible cord net 180.

It should be noted that step 503 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A baseball batting skill improvement system comprising:

a ball catcher bat comprising;

a proximate end having a handgrip shaft portion terminated with a knob;

a barrel portion; and a distal end attached to a ball catcher assembly, said ball catcher assembly having;

a U-hoop having;

an apex end;

a double end; and net rings;

a round mounting plate having;

a first side;

and a second side; and a flexible cord net having attachment loops;

wherein said barrel portion is located between said proximate end and said distal end;

wherein said proximate end of said ball catcher bat is smaller in diameter than said distal end of said ball catcher bat and is useable by a user-batter to grip and swing said ball catcher bat;

wherein said knob comprises a larger diameter than said handgrip shaft portion, said knob prevents said ball catcher bat from sliding out of hands of said user-batter;

wherein said barrel portion progressively increases in diameter starting adjacent said knob on said proximate end towards said distal end;

wherein said first side of said round mounting plate of said ball catcher assembly is removably attached to said distal end of said ball catcher assembly;

wherein said double end of said U-hoop is centered perpendicularly to said second side of said round mounting plate, said U-hoop terminating in said apex end, said U-hoop located on a longitudinal axis of said ball catcher bat, said U-hoop centrally-affixed on a surface area on said round mounting plate;

wherein said flexible cord net is equidistantly and removably attached via said attachment loops to said net rings, said net rings are equidistantly affixed around a periphery of said U-hoop; and wherein said ball catcher bat is usable to catch a baseball within confines of said flexible cord net teaching a swing motion that is correct to said user-batter thereby said baseball batting skill improvement system training said user-batter to have a correct muscle alignment and aim for a proper impact mimicking a regulation baseball bat and a pitched said baseball.

2. The baseball batting skill improvement system of claim 1 wherein said swing motion of said ball catcher bat when aligned properly allows said baseball to enter through said U-hoop perpendicularly to said double end into said flexible cord net thereby providing said user-batter with feed-back of correctness of said swing motion.

3. The baseball batting skill improvement system of claim 2 wherein an opening of said U-hoop is a space located between said double end and comprises a sweet spot, said sweet spot is about 11 inches long and about 1½ ball widths wide in relation to said baseball.

4. The baseball batting skill improvement system of claim 3 wherein said opening of said U-hoop is wider than a diameter of said barrel portion.

5. The baseball batting skill improvement system of claim 1 wherein said ball catcher bat is about regulation baseball bat length and weight.

6. The baseball batting skill improvement system of claim 1 wherein said round mounting plate is removably attached to said barrel portion using at least one lag screw.

7. The baseball batting skill improvement system of claim 6 wherein said round mounting plate further comprises a sleeve centered circumferentially about said barrel portion and is removably affixed to said first side of said round mounting plate.

8. The baseball batting skill improvement system of claim 7 wherein said round mounting plate is attached via said lag screw(s) and said sleeve is attached to said barrel portion via another of said lag screw(s).

9. The baseball batting skill improvement system of claim 8 wherein said round mounting plate is about 2 times the diameter of said barrel portion.

10. The baseball batting skill improvement system of claim 1 wherein said apex of said U-hoop is rounded to mimic an end of said regulation baseball bat, such that air is cut in a similar fashion to swinging said regulation baseball bat.

11. The baseball batting skill improvement system of claim 10 wherein said double end of said U-hoop is welded to said second side of said round mounting plate.

12. The baseball batting skill improvement system of claim 3 wherein said ball catcher bat is usable with a regulation size said baseball and a regulation size soft ball.

13. The baseball batting skill improvement system of claim 12 wherein said ball catcher bat is usable with a hollow plastic practice ball such that said ball catcher bat is able to be used indoors.

14. The baseball batting skill improvement system of claim 1 wherein said flexible cord net comprises holes about one inch across such that said baseball cannot pass therethrough, thereby providing that said user-batter does not have to retrieve said baseball after each successful said swing motion.

15. The baseball batting skill improvement system of claim 14 wherein said flexible cord net comprises a catch bag.

16. The baseball batting skill improvement system of claim 15 wherein said flexible cord net is loose-fitting such that a pitched said baseball will not bounce back out of said flexible cord net, said flexible cord net absorbing momentum of said baseball.

17. The baseball batting skill improvement system of claim 1 wherein said U-hoop, together with said round mounting plate comprises a solid steel construction.

18. A baseball batting skill improvement system comprising:

a ball catcher bat comprising;

a proximate end having a handgrip shaft portion terminated with a knob;

a barrel portion; and a distal end attached to a ball catcher assembly, said ball catcher assembly having;

a U-hoop having;

an apex end;

a double end; and net rings;

a round mounting plate having;

a first side;

and a second side; and a flexible cord net having attachment loops;

wherein said barrel portion is located between said proximate end and said distal end;

wherein said proximate end of said ball catcher bat is smaller in diameter than said distal end of said ball catcher bat and is useable by a user-batter to grip and swing said ball catcher bat;

wherein said knob comprises a larger diameter than said handgrip shaft portion, said knob substantially prevents said ball catcher bat from sliding out of hands of said user-batter;

wherein said barrel portion progressively increases in diameter starting adjacent said knob on said proximate end towards said distal end;

wherein said first side of said round mounting plate of said ball catcher assembly is removably attached to said distal end of said ball catcher assembly;

wherein said round mounting plate is removably attachable to said barrel portion using at least one lag screw;

wherein said round mounting plate further comprises a sleeve centered circumferentially about said barrel portion and is removably affixed to said first side of said round mounting plate;

wherein said round mounting plate is about 2 times the diameter of said barrel portion;

wherein said round mounting plate is attached via lag screw(s) and said sleeve is attached to said barrel portion via another of said lag screw(s);

wherein said double end of said U-hoop is centered perpendicularly to said second side of said round mounting plate, said U-hoop terminating in said apex end, said U-hoop located on a longitudinal axis of said ball catcher bat, said U-hoop centrally-affixed on a surface area on said round mounting plate;

wherein said double end of said U-hoop is welded to said second side of said round mounting plate;

wherein said U-hoop, together with said round mounting plate comprises a solid steel construction;

wherein said apex of said U-hoop is rounded to mimic an end of a regulation baseball bat, such that air is cut in a similar fashion to swinging said regulation baseball bat;

wherein an opening of said U-hoop is a space located between said double end and comprises a sweet spot, said sweet spot is about 11 inches long and about 1½ ball widths wide in relation to a baseball;

wherein said opening of said U-hoop is wider than a diameter of said barrel portion;

wherein said flexible cord net is equidistantly and removably attached via said attachment loops to said net rings, said net rings are equidistantly affixed around a periphery of said U-hoop;

wherein said flexible cord net comprises holes about one inch across such that said baseball cannot pass therethrough, thereby providing that said user-batter does not have to retrieve said baseball after each successful swing motion;

wherein said flexible cord net comprises a catch bag;

wherein said flexible cord net is loose-fitting such that a pitched said baseball will not bounce back out of said flexible cord net, said flexible cord net absorbing momentum of said baseball;

wherein said ball catcher bat is usable to catch said baseball within confines of said flexible cord net teaching said swing motion that is correct to said user-batter thereby said baseball batting skill improvement system training said user-batter to have a correct muscle alignment and aim for a proper impact mimicking said regulation baseball bat and a pitched said base ball;

wherein said ball catcher bat is about said regulation baseball bat length and weight;

wherein said ball catcher bat is usable with a regulation size said baseball; and wherein said swing motion of said ball catcher bat when aligned properly allows said baseball to enter through said U-hoop perpendicularly to said double end into said flexible cord net thereby providing said user-batter with feed-back of correctness of said swing motion.

19. The baseball batting skill improvement system of claim 18 further comprising a kit having:

said ball catcher bat with said U-hoop and said flexible cord net;

at least one said baseball; and a set of user instructions.

* * * * *